US007226516B2

(12) United States Patent
Doremus et al.

(10) Patent No.: US 7,226,516 B2
(45) Date of Patent: Jun. 5, 2007

(54) METHOD FOR MAKING INTEGRATED CIRCUIT ALUMINIUM PANELS

(75) Inventors: Yves Doremus, La Verpilliere (FR); Laurent Poizat, Grenoble (FR); Hayat Elghazal, Chambery (FR)

(73) Assignee: Alcan Rhenalu, Paris (FR)

( * ) Notice: Subject to any disclaimer, the term of this patent is extended or adjusted under 35 U.S.C. 154(b) by 315 days.

(21) Appl. No.: 10/399,776

(22) PCT Filed: Dec. 7, 2001

(86) PCT No.: PCT/FR01/03886

§ 371 (c)(1),
(2), (4) Date: Sep. 25, 2003

(87) PCT Pub. No.: WO02/47841

PCT Pub. Date: Jun. 20, 2002

(65) Prior Publication Data

US 2004/0055668 A1 Mar. 25, 2004

(30) Foreign Application Priority Data

Dec. 11, 2000 (FR) ..... 00 16082

(51) Int. Cl.
*C22F 1/04* (2006.01)

(52) U.S. Cl. ..... 148/535; 428/654

(58) Field of Classification Search ..... 148/535; 426/654

See application file for complete search history.

(56) References Cited

U.S. PATENT DOCUMENTS 2,906,006 A 9/1959 Neel
3,196,528 A 7/1965 Broverman et al.
3,650,005 A * 3/1972 Kamiya et al. ..... 228/118
3,994,753 A * 11/1976 Kanai et al. ..... 148/22
4,820,355 A * 4/1989 Bampton ..... 148/535
4,939,044 A * 7/1990 Ohashi et al. ..... 428/654
6,320,181 B1 * 11/2001 Noji et al. ..... 250/214 VT
6,329,075 B1 * 12/2001 Nener et al. ..... 428/654

FOREIGN PATENT DOCUMENTS

EP 703427 3/1996
FR 2561368 9/1985

* cited by examiner

*Primary Examiner*—George P. Wyszomierski
(74) *Attorney, Agent, or Firm*—Dennison, Schultz & MacDonald

(57) ABSTRACT

The invention relates to an aluminium OSF integrated circuit panel production method comprising surface preparation of two aluminium alloy sheets, deposition on one of the sheets of a weld-proof ink in reserved areas corresponding to the design of the circuit, connection by rolling of the sheets together, and expansion of the channels corresponding to the non-welded areas using a pressurised fluid, wherein one of the sheets is made of 1000 series alloy and the other of an alloy containing iron and manganese and such that Fe+Mn>0.8% (by weight), and preferentially >1, or 1.5%. The iron and manganese alloy is preferentially obtained by continuous casting of strips between two cooled rolls.

The invention also relates to a continuous aluminium alloy integrated circuit panel production method.

18 Claims, 1 Drawing Sheet

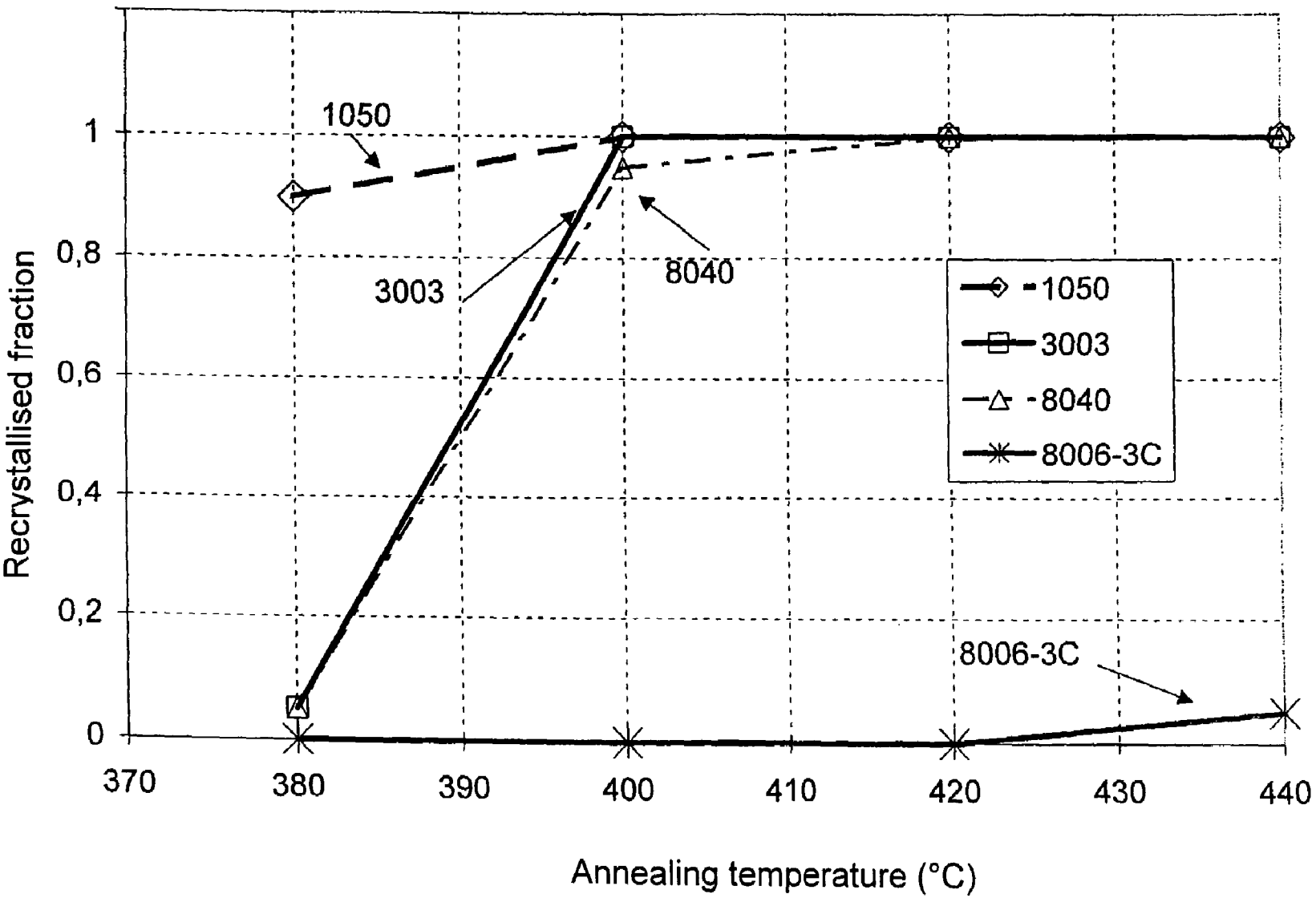
Recrystallised fraction
1
0,8
0,6
0,4
0,2
0
370
380
390
400
410
420
430
440
Annealing temperature (°C)
1050
3003
8040
8006-3C
1050
3003
8040
8006-3C

METHOD FOR MAKING INTEGRATED CIRCUIT ALUMINIUM PANELS

This application is a filing under 35 USC 371 of PCT/FR2001/03886 filed Dec. 7, 2001.

FIELD OF THE INVENTION

The invention relates to a method to produce integrated circuit aluminium panels, generally known as roll-bond, two-sided with two deformed sides or OSF (one side flat) with one flat side and one deformed side. These panels are produced from two aluminium or aluminium alloy sheets, one of which is coated, on the areas intended for the integrated circuit, with an ink intended to prevent welding between the two sheets. The two sheets are then welded by co-rolling. The non-welded areas are then expanded using hydraulic or pneumatic means to form a circuit, wherein the essential part is used as a heat exchanger, particularly as a refrigeration circuit in household refrigerators.

DESCRIPTION OF RELATED ART

The book "L'aluminium", volume 1 "Production—Propriétés—Alliages—Fabrication des demi-produits—Fabrications annexes", published by Editions Eyrolles, Paris 1964, pages 718–721, and the publication "Panneaux aluminium à circuits intégrés: deux lignes de fabrication complémentaires pour de multiples produits", published in La Revue de l'Aluminium, February 1982, described the principle of the roll-bond method to produce two-sided type panels and disclosed the diagram of a continuous production line, and the alloys generally used for panel manufacture. In said continuous production line, the panels are formed from individual sheets (referred to as "plates" in the book), which are conveyed manually or using mechanical conveyance means through the different machines forming the production line.

The patent FR 1347949 (Olin Mathieson) describes the principle of OSF integrated circuit panels and proposes to produce them from two sheets of different mechanical resistance, one made of 1100 alloy and the other of 1100 alloy with 0.12% added zirconium.

The patent FR 2561368 (Cegedur Pechiney) discloses a continuous production method for OSF type roll-bond panels from two sheets made of aluminium or aluminium alloys.

The publication "High Performance Airgap Heat Shields Using Blow-Molded Roll-Bond Aluminum Technology" by V. J. Scott et al., published in the SAE Technical Paper Series (International Congress & Exposition, Detroit, Mich., Feb. 28–Mar. 3, 1994), describes a roll-bond panel production line which comprises straightening and brushing of the two strips, application of the separation medium, preheating and rolling of the strips to form a composite strip, which is then subjected to annealing in a coil in a static furnace.

Therefore, this method is not a continuous method. The use of a static furnace enables more precise control of the annealing conditions than methods using a passage furnace, but the interruption represented by the strip annealing results in economic drawbacks, reduces the production line response time in relation to commercial demand and requires intermediate product stock management.

A specific problem in the roll-bond method is the quality and durability of the channels formed. The European patent EP 0 703 427 (Showa Aluminium) proposes a method which aims to reduce the number of defects during expansion (rupture of channels or local absence of deformation).

According to the observations made by the applicant, existing production lines do not enable the production of panels, particularly OSF panels, with strong mechanical properties. In addition, it is desirable to guarantee that the panels formed, before expansion, are free of redhibitory defects.

The purpose of the invention is to provide a continuous roll-bond panel production method, which is suitable for the production of OSF panels with strong mechanical properties and which enables, both for OSF and two-sided type panels, early detection of defective panels.

SUMMARY OF THE INVENTION

The invention relates to an aluminium OSF integrated circuit panel production method comprising surface preparation of two aluminium alloy sheets, deposition on one of the sheets of a weld-proof ink in reserved areas corresponding to the design of the circuit, connection by rolling of the sheets together, and expansion of the channels corresponding to the non-welded areas using a pressurised fluid, wherein one of the sheets is made of 1000 series alloy and the other of an alloy containing iron and manganese and such that Fe+Mn>0.8% (by weight), and preferentially >1, or 1.5%. The iron and manganese alloy is preferentially obtained by continuous casting of strips between two cooled rolls.

The invention also relates to a continuous aluminium alloy integrated circuit panel production method comprising the following steps:

(a) supply of the production line with two aluminium alloy strips A and B, (b) optionally, straightening of strips A and B, (c) brushing of strips A and B, (d) application on strip A of a weld-proof ink, (e) optionally, quality control inspection of said application, (f) preheating of strips A and B, (g) application using a rolling mill of strip B on the surface of strip A to obtain a composite strip, (h) annealing of the composite strip in a furnace, (i) cooling of the composite strip, (j) optionally, flattening of the composite strip, (k) cutting of the composite strip into panels, (l) optionally, a device enabling the elimination of panels comprising weld-proof ink application defects, detected during the inspection in step e, (m) transfer of the panels into an expansion press with several levels, (n) expansion of the channel, (o) removal of the panels from the press and stacking for packaging.

BRIEF DESCRIPTION OF THE DRAWINGS

The single FIGURE represents, as a function of the annealing temperature, the recrystallised fraction for 1050, 3003, 8040 and 8006 alloy sheets produced by continuous casting.

DESCRIPTION OF THE INVENTION

The applicant noted that the alloys generally used to produce two-sided roll-bond panels may be used, particularly those disclosed in the book "L'aluminium", volume 1 "Production—Propriétés—Alliages—Fabrication des demi-produits—Fabrications annexes", mentioned above. To produce OSF panels, it is necessary, as indicated in patent FR 13479949, during the expansion of the channels, for one of the sides of the panels to be deformed more easily than the other. Therefore, two different alloys are used for the two sides of the composite strip, a harder one forming the flat side, and another less hard one, which is deformed during expansion to form the channels of the circuit. For example, it is known to use the combination of 1050 and 8040 alloys (according to Aluminum Association references). However, the applicant noted during its tests that it is preferable to use for the flat side a strip made of alloy containing iron and manganese and such that Fe+Mn>0.8% (by weight), and preferentially >1, or 1.5%. An example of an alloy of this type of 8006 alloy, wherein the composition registered at the Aluminum Association is as follows (% by weight):

Si<0.40 Fe: 1.2–2.0 Cu<0.30 Mn: 0.30–1.0 Mg<0.10 Zn<0.10.

The iron and manganese alloy strip is preferentially produced by continuous casting of strips, particularly by continuous casting between two cooled rolls, for example using a Pechiney Aluminium Engineering Jumbo 3C™ machine. It is known that alloys containing manganese and/or iron obtained by continuous casting comprise, after a cold rolling procedure performed directly after casting, i.e. with no homogenisation of the cast strip, a fine-grain microstructure giving a higher recrystallisation resistance than the same alloys obtained from rolling ingots. The microstructural properties of such strips obtained by continuous casting have been described in the literature, particularly in the articles by M. Slámováet al.: "Differences in Structure Evolution of Twin-Roll Cast AA8006 and AA8011 Alloys during Annealing", published in the review Materials Science Forum, Vols. 331–337 (2000), pp. 829–834; "Impact of As-Cast Structures on Structure and Properties of Twin-Roll Cast AA8006 Alloy", published in the review Materials Science Forum, Vols. 331–337 (2000), pp. 161–166; "Response of AA 8006 and AA 8111 strip-cast cold rolled alloys to high temperature annealing", published in the Minutes of the ICAA6 Congress, Vol 2, pp. 1287–1292: "Phase-Transformation Study of Two Aluminum Strip-Cast Alloys", published in the Minutes of the ICAA6 Congress, Vol 2, pp. 897–902, but it has not yet been envisaged to use it to form an OSF type roll-bond panel.

The invention also relates to an enhanced two-sided or OSF type aluminium alloy integrated circuit panel production method. In the rest of the disclosure, the term "strip A" will be used to refer to the aluminium or aluminium alloy strip on which the weld-proof ink is applied, "strip B" will be used to refer to the aluminium or aluminium alloy strip which is applied to strip A, "composite strip" will be used to refer to the strip formed from strips A and B, and "panels" will be used to refer to the panels formed by cutting the composite strip.

The continuous method according to the invention comprises the following steps:

(a) supply of the production line with strips A and B, (b) straightening of strips A and B, (c) optionally, brushing of strips A and B, (d) application on strip A of a weld-proof ink, (e) quality control inspection of said application, (f) preheating of strips A and B, (g) creation of a composite strip by passing strip A which comprises the ink, and strip B, under a rolling mill, (h) annealing of the composite strip in a furnace, (i) cooling of the composite strip, (j) optionally, flattening of the composite strip, (k) cutting of the composite strip into panels, (l) optionally, elimination of panels comprising separation medium application defects, detected during the inspection e, (m) transfer of the panels into an expansion press with several levels, (n) expansion, preferentially simultaneously, of the panels on all levels, (o) removal of the panels from the press and stacking for packaging.

Strips A and B may be supplied by two coils. In a preferred embodiment of the invention, each of the two coils is equipped with a mobile joining device, used to change each of the strips A and B without interrupting the feed of the strips in the production line.

Before being introduced into the production line, it is advantageous to degrease the strips, for example using a flame method or any other method known to those skilled in the art.

It is advantageous to brush the surfaces of strips A and B intended to come into contact. Rotary brushes equipped with steel bristles are suitable for this purpose.

The weld-proof ink may be applied onto strip A using screen printing techniques known to those skilled in the art. The quality control inspection of said screen printing may be carried out by a qualified operator. In a preferred embodiment of the invention, the quality of this application is preferentially inspected by an automatic industrial vision device capable of detecting redhibitory defects and of locating the position of defective circuits on strip A. This device acquires the printed image and compares it to a reference considered to be perfect. In this way, this system makes it possible to eliminate, before the expansion of the circuits, panels on which a redhibitory defect has been detected.

Any continuous furnace known to those skilled in the art may be used as the preheating furnace, for example a direct flame furnace. In a preferred embodiment of the invention, said furnace enables the regulation of the temperature so as to keep the temperature constant over the entire width of strips A and B in an interval between ±10° C. maximum, preferentially between ±7° C., or even more preferentially in an interval between ±5° C.

Strip B may be applied to strip A in a conventional rolling mill and preferentially in a quarto rolling mill. In a preferential embodiment of the invention, the two rolls which come into contact with the strip are brushed during rolling. The brushing device disclosed in the French patent FR 2568495 is suitable for this purpose.

Any continuous furnace known to those skilled in the art may be used for the annealing of the composite strip. In a preferred embodiment of the invention, said furnace enables the regulation of the temperature so as to keep the temperature constant over the entire width of the strip in an interval between ±10° C., preferentially between ±7° C., or even more preferentially in an interval between ±5° C. The composite strip may be cooled by spraying with any liquid or gas coolant, and preferentially by sprinkling with water.

If it is necessary to flatten the composite strip at this stage, said flattening may be carried out for example mechanically by means of varying insertion of the strip between two metal roller sheets.

The composite strip may be cut into panels using fixed shears. In this case, it is necessary to add a strip accumulator which makes it possible to cut without interrupting the continuous feed of the strip. In a preferred embodiment of the invention flying shears are used, rendering the strip accumulator liable to induce defects on the composite strip superfluous.

In a preferred embodiment of the invention, the panels wherein defective circuits have been detected during the inspection are then eliminated, before the panels of acceptable quality are transferred to the expansion press. This transfer is advantageously carried out by loading the panels into a lift. Then, the panels are transferred using a robot, for example with a six-axis robot, into the press.

The expansion press comprises several levels, preferentially at least four levels, and even more preferentially at least eight levels. In said press, the circuits are expanded using a pressurised fluid via a needle which is inserted into the expansion channel, between the two sides of each panel. The panels in the press may be expanded one after the other or, preferentially, simultaneously. In a preferential embodiment of the invention, said press is of a design such that it enables the expansion of OSF panels, i.e. panels comprising expanded circuits on one side only, the other side being flat, and two-sided panels, i.e. panels comprising expanded circuits on both sides. To produce OSF panels, a back pressure is applied to the side opposite the flat side, using techniques known to those skilled in the art and described, for example, in the patent FR 2561368 mentioned above.

The panels are advantageously removed from the press by a robot, for example a six-axis robot, which unloads the expanded panels from the press to a chute, which transfers the panels to a stacker used to form stacks of panels ready to be packaged for shipment.

In a preferred alternative embodiment of the invention, strips A and B and the composite strip are centred. For example, centring is useful before the strip enters the roll nip of the rolling mill. FIG. 1 shows a preferred embodiment of the invention.

The invention as described above may be advantageously applied to the production of any roll-bond panels for existing refrigerating appliances or for other heat exchange or transfer applications.

It may also be implemented for the production of panels for structural applications, such as reinforcements for automobile bodywork. The applicant has noted that, in certain cases, it may be advantageous to use a composite panel produced from more than two type A strips, which may contain a single circuit or several circuits, identical or not. In this case, the term "type A strip" refers to the aluminium or aluminium alloy strip(s) on which the weld-proof ink is applied. The term "type B strip" refers to the aluminium or aluminium alloy strip(s) which will be applied onto the type A strip(s), which do not comprise any screen printing. For example, a roll-bond panel composed of three superimposed strips comprising two superimposed circuits is composed of two type A strips and one type B strip. The term "composite strip" refers to the strip formed from type A and type B strips and the term "panels" refers to the panels formed by cutting the composite strip.

In this case, the continuous method according to the invention comprises the following steps:

(a) supply of the production line with two type A strips and one type B strip, (b) straightening of the type A and type B strips, (c) brushing of the type A and type B strips, (d) application of a separation medium onto the type A strips, (e) optionally, quality control inspection of said application, (f) preheating of the type A and type B strips, (g) creation of a composite strip by passing the type A strips which comprise the separation medium, and the type B strip, under a rolling mill, (h) annealing of the composite strip in a furnace, (i) cooling of the composite strip, (j) optionally, flattening of the composite strip, (k) cutting of the composite strip into panels, (l) optionally, elimination of panels comprising ink application defects, detected during the inspection (e), (m) transfer of the panels into an expansion press with several levels, (n) expansion, preferentially simultaneously, of the panels on all levels, (o) removal of the panels from the press and stacking for packaging.

EXAMPLE 1

The line is supplied by a mobile joining device used to change each of the strips A and B without interrupting the feed of the strips in the production line. This carriage is equipped with mobile welding machines with no metal filler to join the strips from the two metal coils.

Strips A and B are straightened by a motorised roller straightening machine.

The surfaces of strips A and B intended to come into contact are brushed by motorised metal brushes.

The screen printing is carried out in a pressurised closed chamber, making it possible to minimise dust deposition and the appearance of defects on the strip. Screens wherein the web structure and thread density are adjusted according to the desired print are used; the screen printing is performed using techniques known to those skilled in the art. The adhesive-proof ink is supplied to the web automatically, enabling good homogeneity of the quantity of ink. The screens are changed when the series is changed without shutting down the line, in a semi-automated fashion. After screen printing, an additional spot of ink is added to strip A at the end of the patterns; said spot is used as a mark when the composite strip is cut into panels.

The quality of the screen printing is inspected by an industrial vision device, equipped with linear cameras. All the patterns are acquired, processed and compared to a reference image. Said device is used to verify the functional dimensions of the patterns and to locate any defects (such as superfluous spots, insufficient ink or imprecisely defined edges). The position of the defective patterns is located by the monitoring computer to be able to remove the panels comprising said defective patterns before the expansion step.

The preheating furnace is a passage gas furnace. It is composed of two parts used to heat strip B and strip A successively. Its output is 1800 kW. The temperature of the strip in the furnace is typically of the order of 400° C., but may reach 500° C., depending on the alloys used. The furnace comprises two by three heating zones. The temperature is kept constant by a regulation system at ±7° C.

The rolling mill used is a quarto rolling mill making it possible to obtain rolling forces of the order of 1400 tonnes, with the possibility of variable balancing.

The annealing furnace is a 1220 kW output passage gas furnace. The temperature of the composite strip in the furnace is typically of the order of 400° C. but may reach 500° C., depending on the alloys used. The furnace comprises four heating zones. The temperature is kept constant by a regulation system at ±7° C.

The composite strip is flattened by a flattening machine comprising 17 variable interlacing rollers, known to those skilled in the art.

An ultrasound sensor is used to detect the spot of ink deposited during the screen printing step and activates the cutting of the composite strip into panels by flying shears. The panels are fed into a lift and are loaded in batches of eight into the expansion pressure using a six-axis robot.

The expansion press is a 2500 tons hydraulic press enabling the simultaneous expansion of the panels on all the levels. Programmed cycles enable the on-line expansion of two-sided and OSF panels. For OSF panels, a back pressure is applied on all the levels in addition to the expansion pressure. The expansion cycles are controlled by a computer. The press is equipped with leak detection devices during expansion and enables the elimination of the defective panels detected.

Panels with expanded channels are unloaded from the press by a second six-axis robot onto a chute. The method's parameters are adjusted according to the feed speed measured at several points of the line. The speed of strips A and B may reach 15 m/min. The speed of the composite strip may reach 30 m/min, for a rolling ratio of 2. The different line settings are controlled automatically from a product database. The width of the strips used may reach 700 mm.

EXAMPLE 2

OSF roll-bond panels were produced by following the method in example 1. Strip A is made of 8006 alloy of the following composition (% by weight):

Si=0.28, Fe=1.20, Cu=0.024, Mn=0.37, Mg=0.0013, Ti=0.017, and was produced by continuous casting between rolls, with no homogenisation of the cast strip before rolling. The cast thickness was 7 mm, and the cast strip was cold-rolled up to 1.2 mm, and then subjected to restoration annealing for 2 hours at 220° C.

Strip B is made of 1050 alloy, 1.26 mm thick, obtained by hot-rolling followed by cold-rolling of rolling ingots.

When removed from the preheating furnace, the temperature of strip A was 480° C., and that of strip B was 380° C. The rolling ratio applied was 2. The composite strip was then annealed in the annealing furnace at different temperatures mentioned in table 1. The Vickers hardness of the two sides after annealing is also given in table 1.

TABLE 1

| Reference | Annealing temperature [° C.] | Vickers hardness of panel on "strip A" side | Vickers hardness of panel on "strip A" side |
|---|---|---|---|
| 1 | 380 | 48.9 | 24.5 |
| 2 | 400 | 46.8 | 23.8 |
| 3 | 420 | 45.5 | 23.3 |
| 4 | 430 | 43.5 | 25.2 |
| 5 | 440 | 42.5 | 23.0 |
| 6 | 460 | 40.2 | 24.7 |

According to the observations made by the applicant, an annealing temperature of 400° C. represents the best compromise between the requirement relating to the flatness and the surface appearance of the flat side (favoured by high hardness of the strip A side) and the requirement for sufficient form of the panel to enable the expansion of the channel without rupture (favoured by low hardness of the strip B side). In any case, it is preferable for the hardness of the panel on the strip A side to be greater than 40 Vickers and preferentially greater than 43 Vickers or even 45 Vickers.

EXAMPLE 3

OSF roll-bond panels were produced by following the method in example 1. Strip A is made of 8040 alloy produced from rolling ingots. The thickness of strip A is 1.26 mm and it was subjected to restoration annealing for 10 hours at 250° C.

Strip B is made of 1050 alloy, 1.26 mm thick, obtained by hot-rolling followed by cold-rolling of rolling ingots.

When removed from the preheating furnace, the temperature of strip A was 480° C., and that of strip B was 380° C. The rolling ratio applied was 2. The composite strip was then annealed in the annealing furnace at temperatures of 400 and 440° C., respectively. The hardnesses of the two sides after annealing are given in table 2.

TABLE 2

| Reference | Annealing temperature [° C.] | Vickers hardness of panel on "strip A" side | Vickers hardness of panel on "strip A" side |
|---|---|---|---|
| 1 | 400 | 38.0 | 25.1 |
| 2 | 440 | 36.2 | 25.2 |

It is noted that lower hardnesses are obtained on the strip A side than in example 2 for equivalent conditions. It cannot be envisaged to reduce the annealing temperature significantly to increase the hardness of the composite strip on the strip A side, since the recrystallisation of the 1050 alloy, which gives it its suitable form in the expansion press, requires, under the conditions of the method according to example 1, a temperature of at least 370 to 380° C.

EXAMPLE 4

A laboratory test was conducted to verify that the 8006 alloy strips obtained by continuous casting show a higher recrystallisation resistance than the other strips generally used to produce OSF roll-bond panels. It is known that the hardness of recrystallised strips is lower than that of non-recrystallised strips; given that a sufficient hardness is needed to be able to use a strip as a flat side of an OSF roll-bond panel, this test makes it possible to preselect the strip that can be used for this purpose.

8040, 8006, 3003 and 1050 strips and sheets, capable of being used to produce roll-bond panels, were prepared by cold rolling. The 8006 alloy was prepared by continuous casting with no homogenisation. The reduction during the cold rolling was by a factor of 2. The sheets were then annealed in salt bath furnaces for 15 s at variable temperatures between 380 and 440° C. and the recrystallised fraction was then determined using a metallographic observation technique known to those skilled in the art.

It is noted in the diagram in the figure that 1050 alloy sheets recrystallise significantly at relatively low temperatures (<400° C.), while 8006 alloy sheets do not recrystallise at all over the entire temperature range studied, which is particularly suitable for use in the method according to example 1.

The invention claimed is:

1. Method for producing an aluminum alloy one side flat integrated circuit panel including a flat side and a deformed side, comprising the steps of:

surface preparation of two aluminum alloy sheets, a first of said sheets corresponding to the deformed side, and a second of said sheets corresponding to the flat side, depositing on one of the sheets a weld-proof ink in reserved areas corresponding to a circuit design, welding the sheets by rolling the sheets together, the reserved areas forming non-welded areas, and expanding channels corresponding to the non-welded areas using a pressurized fluid, wherein the deformed side is made of a 1000 series alloy and the flat side is made of an alloy containing iron and manganese, such that Fe+Mn>0.8% (by weight).

2. Method according to claim 1, wherein Fe+Mn>1%.

3. Method according to claim 2, wherein Fe+Mn>1.5%.

4. Method according to claim 1, wherein the flat side is formed of an 8006 alloy.

5. Method according to claim 1, wherein the flat side sheet is obtained by continuous strip casting.

6. Continuous method for producing an aluminum alloy integrated circuit panel, comprising the steps of:

(a) supplying a production line with an aluminum alloy strip A and an aluminum alloy strip B, (b) optionally straightening strips A and B, (c) brushing strips A and B, (d) applying a weld-proof ink to strip A in reserved areas corresponding to a circuit design, (e) optionally, conducting a quality control inspection of said application, (f) preheating strips A and B, (g) joining, using a rolling mill, strip B on a surface of strip A to obtain a composite strip, the reserved areas forming non-welded areas, (h) annealing the composite strip in a furnace, (i) cooling the composite strip, (j) optionally, flattening the composite strip, (k) cutting the composite strip into panels, (l) optionally, eliminating panels comprising defective ink application, detected during the optional quality control inspection, (m) transferring the panels into an expansion press with a plurality of levels, (n) expanding channels in the composite strip corresponding to non-welded areas, and (o) removing the panels from the press and stacking for packaging.

7. Method according to claim 6, wherein strips A and B are joined together without interrupting the supplying of strip A and strip B.

8. Method according to claim 6, wherein said annealing of the composite strip is carried out such that the composite strip is kept over its entire width at a temperature in an interval between ±10° C.

9. Method according to claim 8, wherein the temperature interval is ±5° C.

10. Method according to claim 6, wherein the preheating of strips A and B is carried out such that each of said strips is kept over its entire width at a temperature in an interval between ±10° C.

11. Method according to claim 10, wherein the temperature interval is ±5° C.

12. Method according to claim 6, wherein the expansion press is equipped with at least 4 levels.

13. Method according to claim 12, wherein the expansion press is equipped with at least 8 levels.

14. Method according to claim 6, wherein the cutting of the composite strip is carried out using flying shears.

15. Method according to claim 6, wherein the rolling mill is a quarto rolling mill.

16. Method according to claim 6, wherein the composite strip at the rolling mill outlet travels at a speed greater than 20 meters per minute.

17. Method for continuous production of aluminum alloy integrated circuit panels formed from at least three metal strips, comprising the steps of:

(a) supplying a production line with two strips of a type A and one strip of a type B, said strips of type A being more easily deformable than said strip of type B, (b) straightening the type A and type B strips, (c) brushing the type A and type B strips, (d) applying of a weld-proof ink onto the type A strips in reserved areas corresponding to a circuit design, (e) optionally, conducting a quality control inspection of said application, (f) preheating the type A and type B strips, (g) forming a composite strip by passing the type A strips and the type B strip through a rolling mill, the reserved areas forming non-welded areas, (h) annealing the composite strip in a furnace, (i) cooling the composite strip, (j) optionally, flattening the composite strip, (k) cutting the composite strip into panels, (l) optionally, eliminating of panels comprising defective ink application detected during the optional inspection, (m) transferring the panels into an expansion press with a plurality of levels, (n) expanding channels in the composite strip corresponding to non-welded areas on all levels, by deforming said strips of type A, (o) removing the panels from the press and stacking for packaging.

18. Method according to claim 17, wherein the expanding of the channels is simultaneous on all levels.

* * * * *